US006357610B1

(12) United States Patent
Irace

(10) Patent No.: US 6,357,610 B1
(45) Date of Patent: Mar. 19, 2002

(54) INTERLOCKING CABINET ASSEMBLY

(76) Inventor: Francisco D. Irace, 6225 SW. Kendale Lake Cir. No. D-152, Miami, FL (US) 33183-0000

( * ) Notice: Subject to any disclaimer, the term of this patent is extended or adjusted under 35 U.S.C. 154(b) by 21 days.

(21) Appl. No.: 09/705,606

(22) Filed: Nov. 3, 2000

(51) Int. Cl.[7] ..... A47F 5/00

(52) U.S. Cl. ..... 211/186; 211/189; 312/265.2; 312/265.3

(58) Field of Search ..... 211/186, 189, 211/191; 312/265.2, 265.3, 257.1

(56) References Cited

U.S. PATENT DOCUMENTS 1,735,375 A * 11/1929 Card et al.
3,497,279 A * 2/1970 Chovanec
4,274,547 A * 6/1981 Takagi et al. ..... 312/257.1 X
4,650,089 A * 3/1987 Davies et al. ..... 312/251.1 X
5,040,690 A * 8/1991 Vander Schoot ..... 211/186 X
5,890,606 A * 4/1999 Kuipers ..... 211/186
6,099,095 A 8/2000 Irace ..... 312/257.1

* cited by examiner

*Primary Examiner*—Robert W. Gibson, Jr.
(74) *Attorney, Agent, or Firm*—J. Sanchelima

(57) ABSTRACT

An interlock cabinet system that in its basic configuration includes two panel assemblies kept at a spaced apart and parallel relationship with respect to each other by four spacer members. The panel assemblies include a central portion flanked by two lateral channel portions. One of the lateral channel portions includes a longitudinal bent termination that, in cooperation with the bent termination of the opposite panel assembly, slidably receives a decorative cover. Each of the lateral channel portions have an inverted U-shape opening that defines a tongue member that is receivable through slots in tab terminations of the spacer members. The spacer members provide horizontal support to shelves.

6 Claims, 2 Drawing Sheets

INTERLOCKING CABINET ASSEMBLY

BACKGROUND OF THE INVENTION

1. Field of the Invention

The present invention relates to an interlocking cabinet assembly, and more particularly, to the type that does not require fastening members or any tool for its assembly.

2. Description of the Related Art

Metallic cabinets have been designed and built for many years. They typically require to be built off-site after taking the measurements of the installation site. The present invention obviates shortcomings associated with this practice and permits a user to assemble standard panel members without requiring the use of fastening members or any tools and involves a ready mounting system with a minimum of parts to assemble. None of the metal cabinet systems found in the prior art disclose the features of the claimed invention.

Applicant believes that the closest reference corresponds to applicant's previous invention disclosed on U.S. Pat. No. 6,099,095, issued on Aug. 8, 2000 for Interlocking Cabinet System. However, it differs from the present invention because the latter does not require any tools for assembly. With the new system the interlocking cabinet is readily mounted directly on site. Its parts permit the cabinet termination to be locked in place and ensures structural stability. Additionally, with the present cabinet system it is possible to assemble two or more adjacent cabinets using common lateral panel walls.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a metallic cabinet system that does not require using any fastening members or tools.

It is another object of this invention to provide such a system for building metallic cabinets that can be readily assembled in multiple configurations by assembling contiguous units.

It is still another object of the present invention to provide a metallic cabinet system that reduces the manufacturing, storage and transportation logistics by reducing the number of parts used.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be fully understood from the following description, when read in conjunction with the accompanying drawings in which.

DETAILED DESCRIPTION OF THE PREFERRED EMBODIMENT

Figure 1:
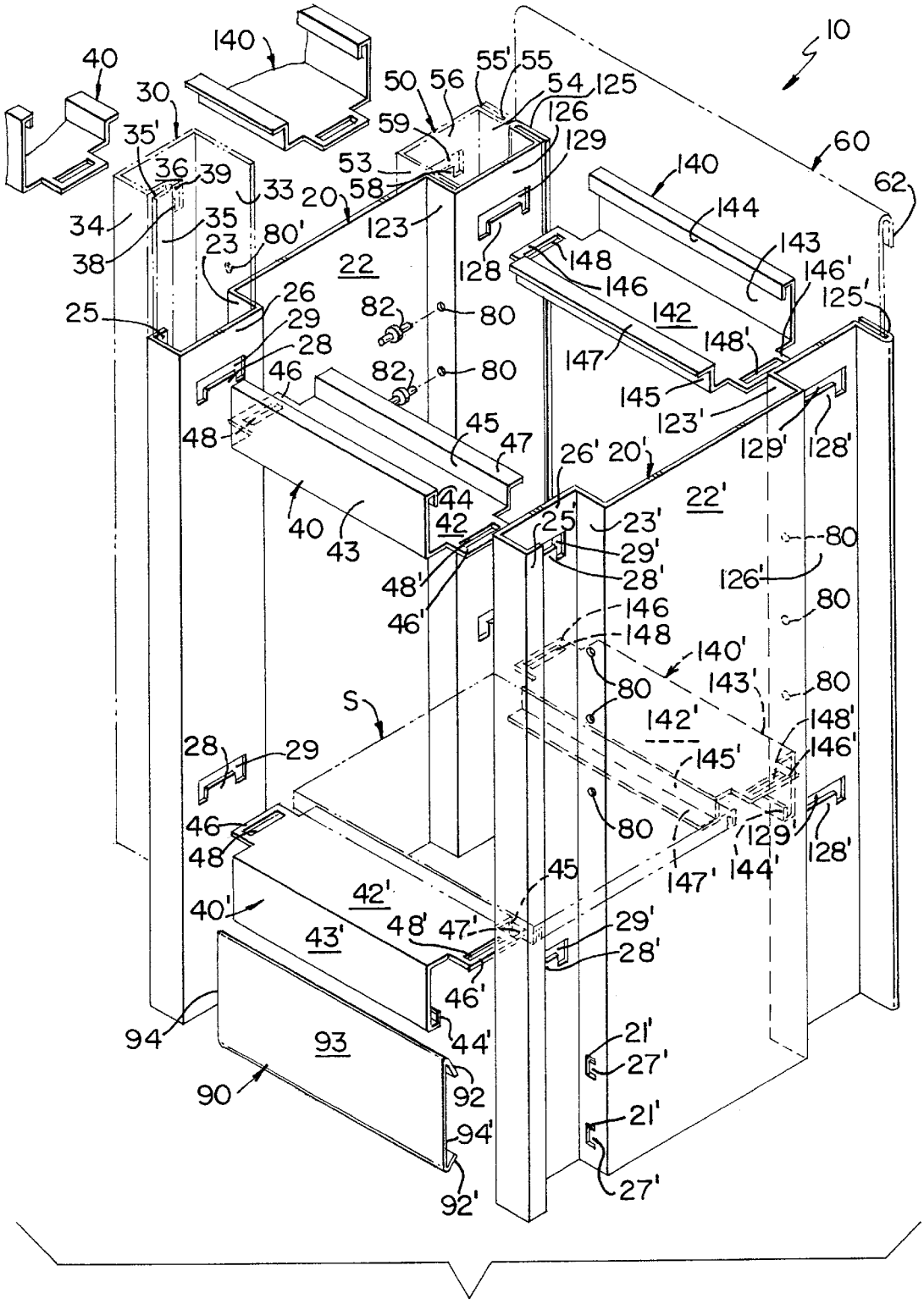
FIG. 1 represents an exploded view of one of the preferred embodiments for the present invention showing one cabinet unit built with the system subject of the present application.

Referring now to the drawings, where the present invention is generally referred to with numeral 10, it can be observed that it basically includes lateral panel assemblies 20 and 20' cooperatively disposed at a parallel and spaced apart relationship with respect to each other by spacer members 40; 40'; 140 and 140' that are perpendicularly mounted to the former. Removable cover member 60 is slidably receivable between longitudinal bent terminations 125 and 125' at one of the vertical ends of panel assemblies 20 and 20', respectively. Bend termination 62 retains cover member 60 in place.

Panel assemblies 20 and 20' include two lateral channels each, namely, lateral channels 26 and 126 for panel 20 and lateral channels 26' and 126' for panel assembly 20'. Central portions 22 and 22' are defined between their respective abutting lateral channels 26; 126; 26' and 126' respectively. Openings 29; 29'; 129 and 129' have an inverted U-shape defining tongues 28; 28'; 128 and 128', respectively. Lateral channels 26 and 26' have at their front ends folded termination 25 and 25' respectively. Lateral channels 26 and 26' also include walls 23 and 23' respectively, next to central portion 22.

Spacer member 40 (and also identical members 40', 140 and 140') includes central wall 42 (and respectively walls 42'; 142 and 142') which includes at its ends tabs 46 and 46' (and tabs 146 and 146') with slots 48 and 48' (and slots 148 and 148'), respectively. Slots 48 and 48' have cooperative dimensions to snugly receive tongues 28 and 28'. Tabs 46 and 46' (146 and 146' also) extend from the ends of central wall 42 (and 42'; 142 and 142') which extends for a predetermined desired length. Adjacent and perpendicularly to wall 42 (and 42'; 142 and 142') is wall 43 (and 43'; 143 and 143') that ends with a longitudinal double folded termination 44 (44'; 144 and 144' also for the other similar spacer members). The other longitudinal edge of central wall 42 (and 42'; 142 and 142') includes longitudinal angular member 45 (and 45'; 145 and 145', respectively), intended to provide a supporting horizontal wall 47 (47'; 147 and 147') for shelves and other accessories referred to generally with letter "S".

To assemble one basic unit of system 10 an installer inserts tabs 46 of spacer member 40 inside openings 29 of panel 20 making slots 48 coincide with tongues 28, The same operation is undertaken for spacers 40'; 140 and 140'. Then, panel 20' is brought against tabs 46' which are in turn inserted through openings 29' and 129'. Cover 60 is optionally slid through bent terminations 125 and 125'. Supporting horizontal walls 47' and 147' provide cooperative support areas for shelves S, or other optional accessories.

Figure 2:
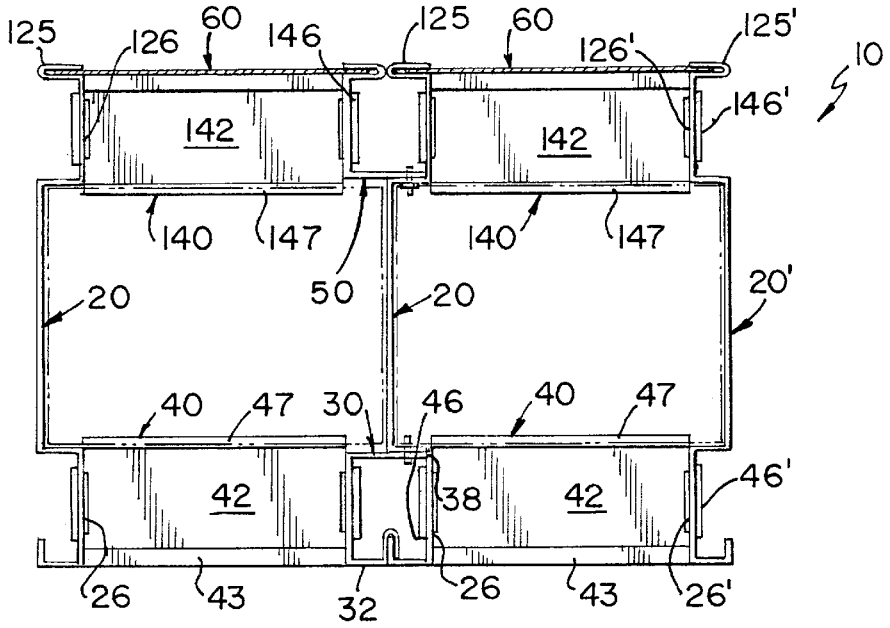
FIG. 2 shows a top view of two contiguous units assembled with the system subject of the present application.

Basic units of system 10 can be assembled contiguously to create configurations of different lengths. To accomplish this two additional parts are needed, front and rear vertical structural members 30 and 50, as shown in FIG. 1 (in phantom) and in the top view of FIG. 2.

Figure 3:
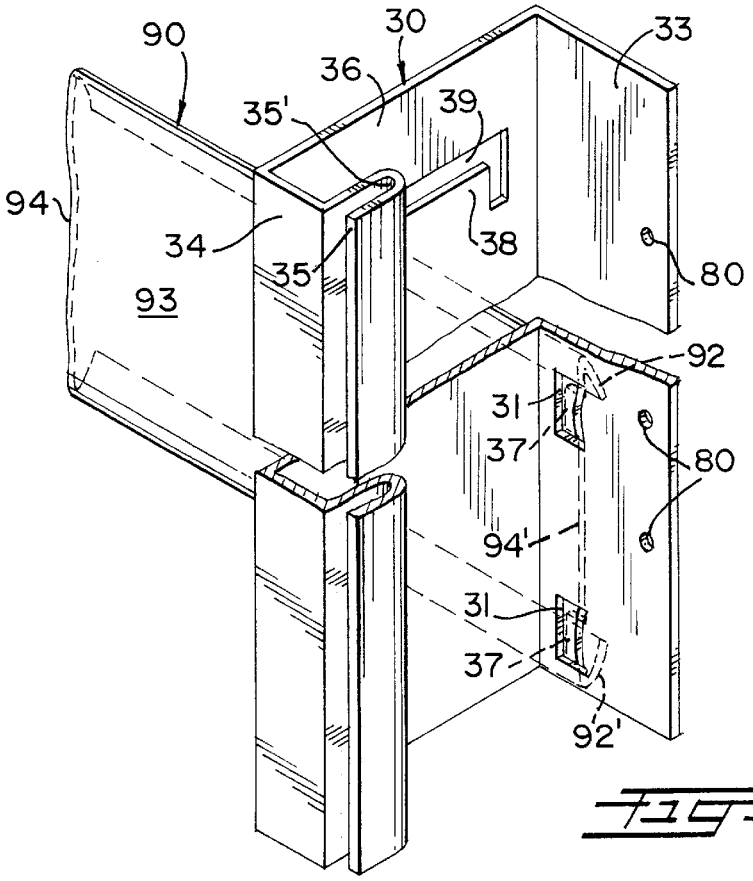
FIG. 3 is broken detail of the elongated engagement member.

To join contiguous units, elongated engagement members 30 and 50 are used. As best seen in FIG. 3, member 30 includes elongated wall 36 with two longitudinal ends. One end includes perpendicularly mounted elongated lateral wall 33 and the other end has elongated lateral wall 34. The distal edge of wall 34 includes, an elongated bent termination 35 defining elongated trough 35'. When contiguous units are joined, elongated trough 35' slidably receive longitudinal folded termination 25 (or 25') of panel assembly 20 (or 20').

Member 50 includes elongated wall 56 with two longitudinal ends. One end includes perpendicularly mounted elongated lateral wall 53 and the other end has elongated lateral wall 54 with elongated bend termination 55 at its distal end. Elongated bend termination 55 defines elongated trough 55' that permits removable cover member 60 to pass through.

Similar to lateral channels 26; 126; 26' and 126', elongated engagement member 30 and 50 include openings 39 and 59 respectively, having an inverted U-shape and defining tongues 38 and 58 respectively, to permit tab 46 (or 46'; 146 and 146') of spacer member 40 (or 40'; 140 and 140') be inserted through.

Cover member 90 includes front wall 93 with folded terminations 92 and 92' at its top and bottom ends respectively. Member 90 also includes lateral ends 94 and 94'. To keep member 90 in place, ends 94'is inserted laterally between openings 21' and tongue 27' of panel assembly 20' (the same for end 94 with panel assembly 20). As best seen in FIG. 3, end 94' is inserted between openings 31 and tongues 37 of structural member 30. Terminations 92 and 92' help to secure member 90 and prevents it from moving.

Walls 23; 23'; 123 and 123' of lateral channels 26; 126; 26' and 126' in panel assemblies 20 and 20', also have openings 80 for pin members 82 to secure panel assemblies 20 and 20' with elongated engagement members 30 and 50 when contiguous units are joined.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An interlock cabinet system, comprising:

A) first and second panel assemblies positioned opposite to each other and each having two lateral channels each having a distal longitudinal edge and a central portion in between, each of said lateral channels including first and second ends having inverted U-shape openings adjacent to said first and second ends and said U-shape openings define tongue members therein; and B) at least four spacer members for keeping said panel assemblies at a separate and spaced apart relationship with respect to each other, each of said spacer members including an elongated central wall having first and second longitudinal edges and third and fourth ends, and said third and fourth ends including first and second tab members each having first and second slots of cooperative dimensions to snugly receive said tongue members.

2. The cabinet system set forth in claim 1 further including a cover member mounted to two opposite lateral channels.

3. The interlock cabinet system set forth in claim 2 wherein said spacer members include a longitudinal angular member mounted to said first longitudinal edge thereby providing cooperative horizontal supporting surfaces for shelves and other accessories.

4. The cabinet system set forth in claim 3 further including:

C) first and second elongated engagement members coextensive with said channels and including cooperatively located inverted U-shape slots; said elongated engagement members including two lateral longitudinal edges having first and second lateral longitudinal walls perpendicularly mounted thereon and said first lateral longitudinal wall including a bent termination defining a longitudinal trough for cooperatively receiving said distal longitudinal edge;

D) at least one set of four of said spacer members and a third panel assembly to which said spacer member are mounted so that another cabinet unit is defined.

5. The cabinet set forth in claim 4 wherein said mounting means includes a double folded edge on said first lateral channel of said first panel to provide a longitudinal edge and said first elongated structural member includes a U-shape bent termination cooperatively dimensioned to receive said longitudinal edge thereby keeping said cabinet units secured to each other.

6. The cabinet set forth in claim 5 further including fastening means for keeping said second elongated structural member secured to said second channel of said first panel.

* * * * *